United States Patent [19]

Olsson et al.

[11] Patent Number: 4,683,523

[45] Date of Patent: Jul. 28, 1987

[54] DEEP SUBMERSIBLE LIGHT ASSEMBLY

[76] Inventors: Mark S. Olsson, 4968 Diane Pl.; William H. Hagey, 3653 Jennifer St., both of San Diego, Calif. 92117; Brock J. Rosenthal, 230 Fourth St., Del Mar, Calif. 92014

[21] Appl. No.: 874,271

[22] Filed: Jun. 13, 1986

[51] Int. Cl.[4] ..... F21V 29/00

[52] U.S. Cl. ..... 362/267; 362/158; 362/307

[58] Field of Search ..... 362/267, 158, 307, 347

[56] References Cited

U.S. PATENT DOCUMENTS

| | | | |
|---|---|---|---|
| 2,051,479 | 8/1936 | Hastings | 362/267 |
| 3,652,846 | 3/1972 | Starck | 362/158 |
| 4,368,508 | 1/1983 | Gantenbrink | 362/267 |

FOREIGN PATENT DOCUMENTS

| | | | |
|---|---|---|---|
| 2164137 | 3/1986 | United Kingdom | 362/158 |

*Primary Examiner*—Douglas Hart

*Attorney, Agent, or Firm*—Baker, Maxham & Jester

[57] ABSTRACT

An elongate metal cylindrical body has a plurality of internal annular grooves for adjustable positioning of a lamp socket. A cylindrical metal sleeve screws over the forward end of the metal body. A quartz-halogen lamp extends through the forward end of the sleeve and tube and its contacts are received in corresponding receptacles in the socket. A cylindrical heat sink is screwed inside the metal sleeve and surrounds the base of the lamp, closely spaced therefrom. A relatively small protective glass envelope fits over the lamp and heat sink. The tapered rearward end of the glass envelope is held within a cavity in the forward end of the metal sleeve by a special radial seal, including an O-ring and a spiral retaining ring. The special seal also minimizes cracking of the envelope while providing a barrier to the entry of water under high pressure. A readily removable reflector assembly fits over the forward ends of the cylindrical metal body and sleeve and includes a perforated dome-shape protective cover. The rear end of the cylindrical metal body accommodates a variety of standard bulkhead electrical connectors.

10 Claims, 4 Drawing Figures

DEEP SUBMERSIBLE LIGHT ASSEMBLY

BACKGROUND OF THE INVENTION

The present invention relates to spot lights and flood lights, and more particularly, to underwater light assemblies for marine applications.

Both manned and remotely piloted deep submersible vehicles are typically equipped with external light assemblies for illuminating adjacent water regions or structures otherwise hidden in the darkness. Such light assemblies must be capable of withstanding extremely high pressures and temperatures slightly below 32 degrees F. They must also be capable of providing a high degree of illumination since there is virtually no light from the surface and visibility is sometimes further impaired by debris. However, such light assemblies must not have undue power consumption since deep submersible vehicles typically operate on battery power.

SUMMARY OF THE INVENTION

It is the object of the present invention to provide an improved deep submersible light assembly.

According to the illustrated embodiment of our invention an elongate metal cylindrical body has a plurality of internal annular grooves for adjustable positioning of a lamp socket. A cylindrical metal sleeve screws over the forward end of the metal body. A quartzhalogen lamp extends through the forward end of the sleeve and tube and its contacts are received in corresponding receptacles in the socket. A cylindrical heat sink is screwed inside the metal sleeve and surrounds the base of the lamp, closely spaced therefrom. A relatively small protective glass envelope fits over the lamp and heat sink. The tapered rearward end of the glass envelope is held within a cavity in the forward end of the metal sleeve by a special radial seal including an O-ring and a spiral retaining ring. The special seal also minimizes cracking of the envelope while providing a barrier to the entry of water under high pressure. A readily removable reflector assembly fits over the forward ends of the cylindrical metal body and sleeve and includes a perforated dome-shaped protective cover. The rear end of the cylindrical metal body accommodates a variety of standard bulkhead electrical connectors.

DESCRIPTION OF THE PREFERRED EMBODIMENT

Figure 1:
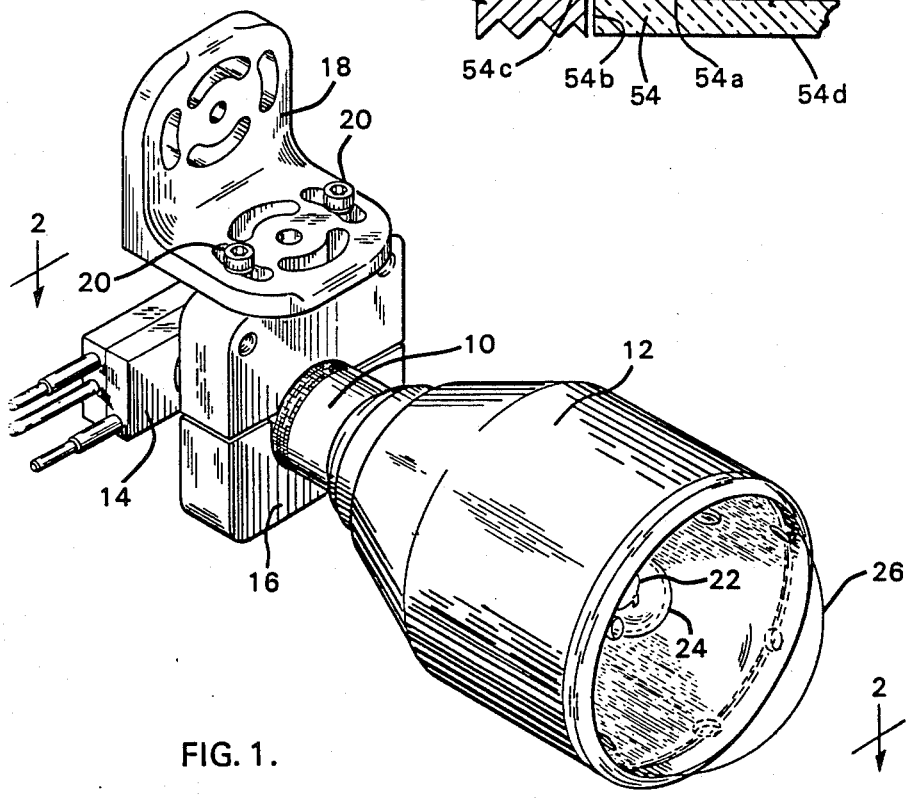
FIG. 1 is a perspective view of the preferred embodiment of our light assembly.

Referring to FIG. 1, the preferred embodiment of our light assembly includes a cylindrical metal body 10 having a reflector assembly 12 fit over its forward end and a bulkhead electrical connector 14 plugged into its rear end. A two-piece bulkhead mounting clamp 16 surrounds the metal body 10 rearward of the reflector 12. An L-shaped bulkhead mounting bracket 18 is adjustably connected to one-half of the mounting clamp 16 by Allen screws 20. A quartz-halogen lamp 22 is connected to the forward end of the metal body 10 inside the forward opening cavity of the reflector 12. A PYREX (trademark) borosilicate glass envelope 24 is sealed over the lamp 22 to insulate the same from sea water. A dome-shaped transparent cover 26 made of LEXAN (trademark) extends across the forward end of the reflector cavity to protect the lamp 22 and envelope 24 from breaking as a result of objects or debris that strike the forward end of the light assembly. Metal bars or a wire mesh can be substituted for the transparent cover 26.

Figure 2:
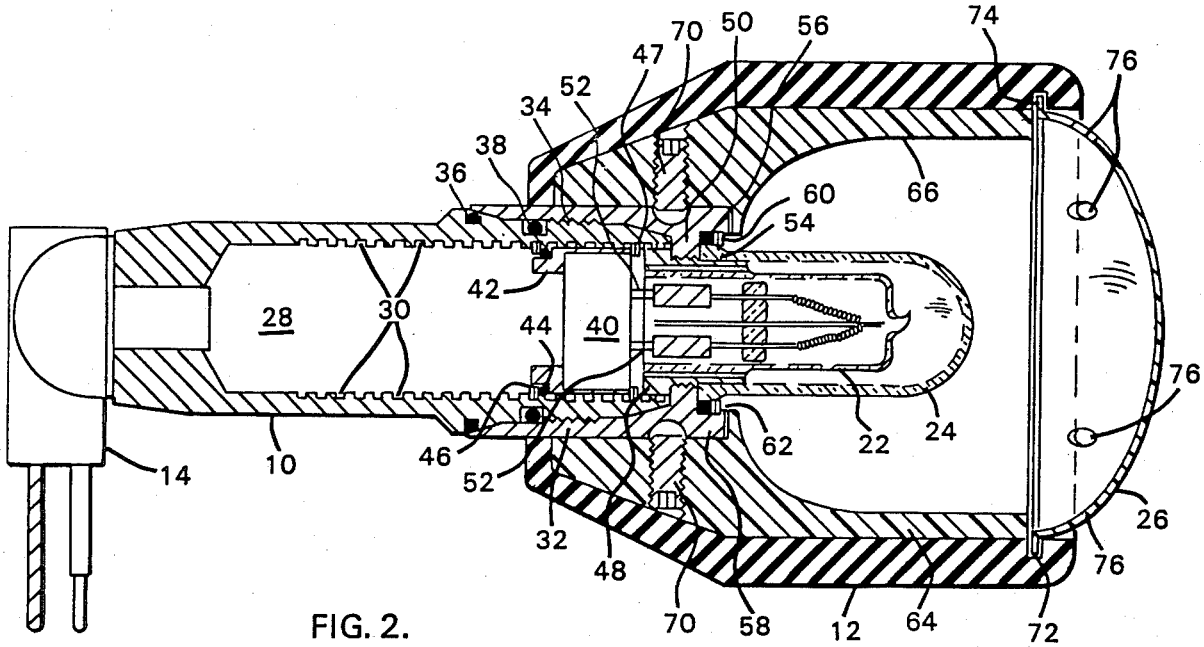
FIG. 2 is an enlarged longitudinal sectional view of the preferred embodiment taken along line 2-2 of FIG. 1. The rear bulkhead electrical connector is shown in elevation. The bulkhead mounting clamp is not illustrated for the sake of clarity.

Referring to FIG. 2, the cylindrical metal body 10 has an internal cylindrical bore 28 and a plurality of annular grooves 30 formed in the inside wall thereof. These grooves are parallel and are spaced apart an equal distance along the longitudinal axis of the metal body 10. Alternatively, a small number of grooves at select distances apart may be used. The grooves need not be spaced equal distances apart. A cylindrical metal sleeve 32 has a tapered inner wall with an internally threaded segment that screws over a mating externally threaded segment on the tapered outer wall at the forward end of the body 10, forming a threaded joint 34. The tapered joint takes up the axial load of the pressure on the envelope and sleeve. Both the cylindrical body 10 and the cylindrical sleeve 32 may be made of Aluminum, Titanium or stainless steel, turned on a lathe to produce the illustrated contours. A pair of O-rings 36 and 38 are seated in annular grooves in the outside of the aft portion of the tapered outer wall of the cylindrical body 10. These O-rings are squeezed by the rearward end of the cylindrical metal sleeve 32 when the same is screwed over the forward end of the cylindrical body 10, thereby providing a double seal against the entry of sea water.

Figure 3:
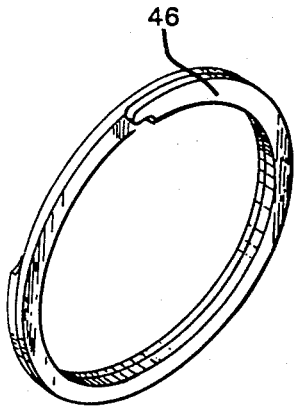
FIG. 3 is a further enlarged view of a spiral retaining ring of the type used in the preferred embodiment.

Referring still to FIG. 2, the cylindrical bore 28 opens at the forward end of the body 10 to permit the lamp 22 to be mounted therein. A bi-pin female lamp socket 40 is mounted inside a surrounding support ring or lamp socket holder 42. A bayonet, screw base or other lamp/socket connection may be used. The rear end of the support ring 42 butts up against an O-ring 44 which in turn butts up against a spiral retaining ring 46 of the type illustrated in FIG. 3. This type of ring is made of metal and can be in FIG. 3. This type of ring is made of metal and can be compressed for installation in one of the annular grooves 30 of the metal body 10 and will thereafter expand in spring-like fashion to stay in position. Another identical spiral snap ring 47 is seated in another one of the grooves 30 to hold the forward end of the socket 40. The longitudinal position of the socket 40 can be adjusted to accommodate different length lamps while maintaining a fixed filament position relative to the body 10 and the reflector 12. This is accomplished by moving the snap rings 46 and 47 to different grooves 30. It also allows the position of the lamp 22 to ensure the placement of the filament at the focus of the reflector. The O-ring 44 prevents rotation of the lamp socket. It also allows some tolerance variation and provides a degree of shock isolation.

The quartz-halogen lamp 22 provides a high degree of illumination for a given amount of electric power. The outside temperature of the quartz bulb enclosing the filament must maintain a temperature of between about 200 degrees and 500 degrees C. If too much heat is extracted from the quartz bulb, the illumination will be seriously degraded. If the bulb gets too hot, melt down may occur. It is also preferable that the base of the lamp 22 be kept at a temperature below 250 degrees C. Accordingly, the lamp 22 is enclosed within the envelope 24 to prevent cold sea water from coming into direct contact with the quartz bulb of the lamp. Furthermore, the base of the lamp 22 is surrounded by, and spaced slightly from, a cylindrical copper heat sink 48. The heat sink has external threads and is screwed into engagement with internal threads formed in a shoulder 50 which extends radially inwardly at the forward end of the body 10. The contacts or pins 52 which extend from the base of quartz-halogen lamp 22 are inserted into corresponding contact receptacles in the socket 40. This keeps the bulb portion of the lamp concentrically positioned within the cylindrical copper heat sink 48. The lamp may have other means for connecting its base to the socket. There is a slight annular air gap between the inner wall of the heat sink and the outer wall of the quartz bulb.

The heat sink 48 has several important functions. It shields the O-ring used in the radial seal for the rear end of the glass envelope 28, which is discussed in detail hereafter. This O-ring could otherwise be damaged by the heat from the filaments in the lamp 22. The heat sink removes heat from the inside of the glass envelope 24. The outer surface of the envelope 24 thus stays cooler. This prevents scaling, i.e. chemical buildup on the surface due to high temperatures and contamination. The heat sink 48 also helps maintain internal free convection within the envelope to enhance and evenly distribute thermal conductive cooling.

The inside diameter of the glass envelope 24 is preferably less than or equal to twice the outside diameter of the quartz bulb of the lamp 22 it encloses. This improves the efficiency of the surrounding reflector 12 and also minimizes the overall size of the light assembly, thereby minimizing hydrodynamic drag.

Our invention uses a special type of radial seal to join the rear end of the glass envelope 24 to the metal sleeve 32. Ideally, the pressure bearing area where the glass meets the metal should be smooth and flat. Under high pressure loads, e.g. those experienced at depths of several thousand feet, the glass and its underlying supporting metal surface are in compression and will move relative to one another. It is almost impossible to simultaneously match deflections due to thermal strains. The mating surfaces must be smooth to allow sliding since sticking will cause tensile cracking of the glass surface. An O-ring facing the pressure bearing surface of the glass acts as a stress riser. The pressure on this surface is equal to the surrounding hydrostatic pressure. An O-ring or flat gasket used as a face seal causes shearing forces in the glass that can lead to cracking.

Figure 4:
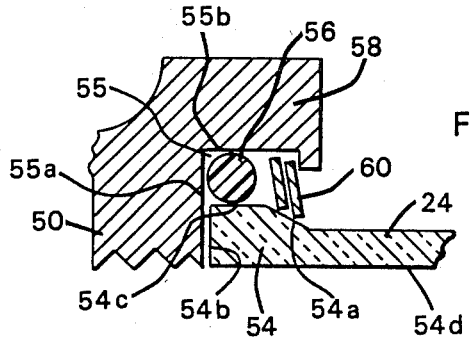
FIG. 4 is a further enlarged view of a portion of Fig. 2 illustrating details of the radial seal used in our invention.

In order to overcome the aforementioned problem, our light assembly uses a radial seal to mate the rear end of the glass envelope with the cylindrical metal sleeve 32. Referring to FIG. 4, the rear end of the glass envelope has a shoulder 54 with a radially tapered outer surface 54*a* that decreases in diameter moving in a forward direction. An O-ring 56 is seated against the rearward wall 55*a* and inwardly facing wall 55*b* of a cylindrical cavity 55 in the forward end of the sleeve 32 formed by the shoulder 50 and projecting portion 58 of the sleeve. The O-ring 56 is positioned radially outward of the shoulder 54 of the glass envelope 24. A spiral retaining ring 60 is positioned within the cavity 55 at the forward end of the metal sleeve 32 and engages the tapered outer surface 54*a* of the glass shoulder 54. The inside diameter of the spiral retaining ring is slightly smaller than the largest outside diameter of the shoulder 54 of the glass envelope when the ring is compressed within the cavity. The ring is held in position by a radially inwardly projecting lip 62 at the forward end of the projecting portion 58. The retaining ring 60 thus rides against the tapered outer surface 54*a* of the glass shoulder 54, forward of the larger diameter portion of the shoulder. The glass shoulder 54 causes the retaining ring 60 to function like a Belville spring. This is illustrated by the canted position of the ring 60 in FIG. 4.

The flat rearward face 54*b* (FIG. 4) of the glass shoulder 54 is in contact with the rearward wall 55*a* of the cavity. The rearward face 54b extends perpendicular to the longitudinal axis of the glass envelope 24. The shoulder has a cylindrical outer surface 54*c* extending forward from the rearward face 54*b*. The lip 62 is positioned a predetermined distance from the rearward wall 55*a* of the cavity so that the retaining ring 50 presses the O-ring 56 and the rearward face 54*b* of the glass shoulder 54 against the rearward wall 55*a* of the cavity. Sea water is thereby prevented from entering the forward end of the cylindrical metal body 10. Increased water pressure compresses the O-ring 56 and pushes the rearward face 54*b* of the shoulder 54 tighter against the rearward wall 55*a* of the cavity 55 enclosing the O-ring and glass shoulder. This further increases the tightness of the seal.

The inner wall 54*d* of the rearward end of the glass envelope 24 abuts against the outer wall of the forward end of the copper heat sink 48 (FIG. 2).

Our radial seal results in less stress on the glass envelope than a face seal, i.e. one in which the glass is pressed down directly against an O-ring or gasket sandwiched between the rear end of the glass and the forward end of the metal mounting member.

Our radial seal can function with alternatives to the spiral retaining ring 60. A threaded ring could be provided that would screw down against the glass shoulder 54, with the other structures in their same locations illustrated in FIG. 2. Another type of retaining ring known as a "circlip" could be used. Also, a press-type ring could be used in place of the spiral retaining ring 60. The rearward face 54*b* of the envelope 24 could be covered with a low friction coating. This would improve the fatigue characteristics of the glass under cyclic pressure loading.

The reflector assembly 12 is made of an inner body 64 defining a parabolic or other reflecting surface 66, and an outer body 68. The rearward end of the inner body fits snugly over the forward end of the sleeve 32 and is secured thereto by nylon tipped stainless steel set screws 70. The sleeve 32 and/or the inner body 64 may have longitudinal slots (not illustrated) to permit the passage of sea water for cooling. One of the set screws may engage a slot to prevent rotation of the reflector assembly. The outer body 68 fits over the inner body and has an inwardly facing annular groove 72 at the forward end thereof for receiving the radial outer flange 74 of the transparent cover 26. The flange 74 is held against the forward end of the inner body 64 of the reflector. The inner and outer reflector bodies may be made of cast polyurethane, DELRIN (trademark), Aluminum or other suitable material capable of absorbing blows. The outer body 68 is sufficiently flexible to permit it to be peeled back to allow removal and replacement of the transparent cover 26. The cover 26 not only protects the lamp and surrounding envelope from breakage, but also helps to streamline the light assembly. The inner reflecting surface 66 is painted white or the inner 64 may be molded or cast of inherently white material. The transparent cover 26 has circumferentially spaced holes 76 therethrough to permit sea water to flow into the reflector cavity to thereby equalize the pressure which would otherwise collapse the reflector. The reflector assembly 12 can be easily removed and replaced with another reflector having a different shape, without dismounting, unplugging or opening the light assembly. The beam shape can thus be readily modified for different mission requirements, i.e. spot or flood. The plastic tipped set screws 70 prevent breaking or other damage of the annodized surface on the sleeve 32 if it is Aluminum. They also prevent galvanic corrosion.

The rear bulkhead electrical connector 14 is conventional in design and therefore has only been illustrated in elevation, and not in section. It plugs into a bore in the rearward end of the cylindrical metal body 10 and may be readily removed and replaced with an inline connector or other connectors. The connector 14 has elastomeric portions which provide a water tight seal at the rearward end of the body 10. A bulkhead penetrator may also be used. For the sake of clarity, the wires which extend inside the bore 28 and connect the socket 40 with the connector 14 have not been illustrated.

The lamp 22 may be readily replaced by manually rotating the reflector assembly 12, which unscrews the sleeve 32 from the body 10, revealing the lamp. It is important to note that the radial seal is not disturbed, i.e. the contact between the rearward face **54*b* of the glass envelope 24 and the wall 55*a*** is not broken, lessening the likelihood of fractures in the envelope. It also is not necessary to remove the light assembly from the bulkhead.

Having described in detail a preferred embodiment of our deep submersible light assembly, it will be understood by those skilled in the art that our invention may be modified in both arrangement and detail. Therefore the protection afforded our invention should only be limited in accordance with the scope of the following claims.

We claim:

1. A submersible light assembly, comprising:

a hollow body having at least one opening;

a lamp socket;

means for holding the lamp socket in a predetermined position within the body;

a lamp having contacts removably inserted in the socket and a bulb extending through the opening and having a base connectable with the socket;

a transparent cylindrical envelope enclosing a portion of the lamp and having a closed forward end an an open rearward end with a radially outwardly projecting shoulder, the shoulder having a flat rearward face extending perpendicular to a longitudinal axis of the envelope, a cylindrical outer surface extending forward from the rearward face, and a radially tapered outer surface forward of the cylindrical surface and decreasing in diameter moving in a forward direction; and means for holding the rearward end of the transparent envelope to the body including means connected to the body for defining a cylindrical cavity adjacent the opening, the rearward face of the transparent envelope being abutted against a rearward wall of the cavity, an O-ring radially seated in the cavity surrounding the cylindrical outer surface of the shoulder of the transparent envelope, and means for engaging the tapered outer surface of the shoulder and pressing the O-ring and the rearward face of the shoulder against the rearward wall of the cavity.

2. A light assembly according to claim 1 wherein the body is cylindrical and the holding means includes a tapered cylindrical sleeve that screws over a forward externally threaded end of the body defining the opening.

3. A light assembly according to claim 2 wherein the cavity is formed in a forward end of the cylindrical sleeve.

4. A light assembly according to claim 3 wherein the sleeve has a radially inwardly projecting lip forward of the rearward wall of the cavity and the engaging means includes a spiral retaining ring.

5. A light assembly according to claim 2 wherein the cylindrical body has an elongate cylindrical bore formed with a plurality of axially spaced annular grooves and a pair of rings removably seated in corresponding ones of the grooves for holding the socket in a predetermined longitudinal position within the cylindrical body, and a second O-ring is positioned between one of the rings and the socket.

6. A light assembly according to claim 4 and further comprising a reflector assembly removably attached to the sleeve and having a reflecting surface surrounding the lamp.

7. A light assembly according to claim 6 wherein the reflector assembly includes a perforated transparent cover extending across a forward end thereof.

8. A light assembly according to claim 1 wherein the inside diameter of the transparent envelope is less than or equal to twice a width dimension of the lamp.

9. A light assembly according to claim 2 and further comprising a bulkhead electrical connector removably attached to a rearward end of the cylindrical body.

10. A light assembly according to claim 2 and further comprising a cylindrical heat sink surrounding a rearward end of the bulb and screwed into the cylindrical sleeve.

* * * * *